United States Patent [19]

Forbes, Jr.

[11] Patent Number: 4,705,173

[45] Date of Patent: Nov. 10, 1987

[54] CARRYOUT TRAY WITH DIVERSE APERTURES

[75] Inventor: Hampton E. Forbes, Jr., Newark, Del.

[73] Assignee: Westvaco Corporation, New York, N.Y.

[21] Appl. No.: 937,207

[22] Filed: Dec. 3, 1986

[51] Int. Cl.[4] ..... B65D 1/34

[52] U.S. Cl. ..... 206/563; 206/45.19; 229/904

[58] Field of Search ..... 206/557, 561, 562, 563, 206/565, 218, 541, 45.19; 229/DIG. 13, 904, 28 R, 43

[56] References Cited

U.S. PATENT DOCUMENTS

| | | | |
|---|---|---|---|
| 2,512,963 | 6/1950 | Peiker | 229/28 R |
| 2,808,191 | 10/1957 | Cramer | 229/28 R |
| 2,924,372 | 2/1960 | Kirkeby | 229/28 R |
| 3,005,584 | 10/1961 | Coe | 206/45.14 |
| 3,209,980 | 10/1965 | Festa | 229/28 R |
| 3,326,445 | 6/1967 | Goings | 229/28 R |
| 3,326,446 | 6/1967 | Goings | 229/28 R |
| 3,394,862 | 7/1968 | Coe | 229/28 R |
| 3,400,875 | 9/1968 | Coe | 229/28 R |
| 3,434,649 | 3/1969 | Goings | 229/28 R |
| 3,637,130 | 1/1972 | Farguhor | 229/28 R |
| 3,730,419 | 5/1973 | Botterman et al. | 229/28 R |
| 3,899,119 | 8/1975 | Roccaforte | 206/562 X |
| 4,156,484 | 5/1979 | Wischvsen | 206/565 |
| 4,469,271 | 9/1984 | Kulig | 229/28 R |
| 4,474,324 | 10/1984 | Forbes, Jr. | 229/43 X |
| 4,562,926 | 1/1986 | Mode | 206/563 |

FOREIGN PATENT DOCUMENTS

| | | | |
|---|---|---|---|
| 268988 | 2/1969 | Austria | 229/28 R |
| 96537 | 12/1983 | European Pat. Off. | 229/28 R |

*Primary Examiner*—Stephen Marcus
*Assistant Examiner*—Bryon Gehman

[57] ABSTRACT

A generally rectangular carryout tray for fast food restaurants is provided with top, bottom and side walls. The top wall includes openings in distinct areas for accomodating different kinds of food. The tray is constructed so taht it can be collapsed for storage before use and readily erected for use with a simple motion. The top wall is supported above the bottom wall by an integral bridge element prepared from the top wall material taken from one of the food accomodating areas. Each food accomodating area also includes deflectable flap elements and tabs which further support and position the various food products in their designated areas.

1 Claim, 4 Drawing Figures

18
31
30
19
32
37
33
38
34
20
35
40
45
42
36
54
57
50
17
43
53
55
41
44
52
56
51
26
16
15
28
23
14
10
24
22
21
25
13
12
27
29
11

CARRYOUT TRAY WITH DIVERSE APERTURES

BACKGROUND OF INVENTION

The present invention relates to a food service carton and more particularly to a carryout tray formed from a one-piece blank of paperboard capable of being folded from a collapsed condition for storage to an erect condition for use.

Carryout trays and cartons for carrying prepared foods away from fast food restaurants and other food vendors are old in the art. The trays used for that purpose typically contain cavities which are sized so as to receive various shaped products such as cups, bags and boxes. The cavities are intended to support the various food products, keep them separated from one another and to prevent spillage. Another desirable feature of such trays is that they should be easy to store for use, erect when needed and remain sturdy in transit. However, most if not all of the prior art constructions suffer from defects in design, or if designed properly, become too expensive for the intended use. U.S. Pat. Nos. 4,562,926 and 4,572,423 are two examples of such trays.

SUMMARY OF INVENTION

The carryout tray of the present invention comprises an integral construction defined by top, bottom, side walls and end closures. The tray is prepared in the form of a flap top box with an autolock bottom except that the flap top becomes one end closure and the autolock bottom becomes the other end closure. This arrangement is used so that the tray may be readily folded from a flat collapsed condition for storage to an upright erected condition for use without excessive manipulation.

The top of the tray includes the usual cut out openings for accepting and isolating different products and a unique, integral bridge element is provided between the top wall and bottom wall to keep the tray from collapsing inadvertently and for providing support for the top wall when the various products are loaded. Each of the product receiving openings are also provided with deflectable panels cut from the top wall material which flaps are deflected below the top of the tray when the products are loaded. The deflectable panels provide additional support for the products and prevent the products from being spilled or from moving laterally within the product receiving openings when the tray is bumped or tilted.

It is therefore, an object of the present invention to provide an improved carryout tray which overcomes the limitations of the prior art boxes and trays.

It is a further object to provide a carryout tray which may be converted from a flat storage condition to an erected operable condition.

Yet another object of the present invention is to provide a bridge element between the top and bottom walls of the tray to provide support for the top wall and to keep the tray from inadvertently collapsing.

These and other objects and advantages of the invention will become more readily apparent from the following detailed description of a preferred embodiment thereof.

DETAILED DESCRIPTION

Figure 1:
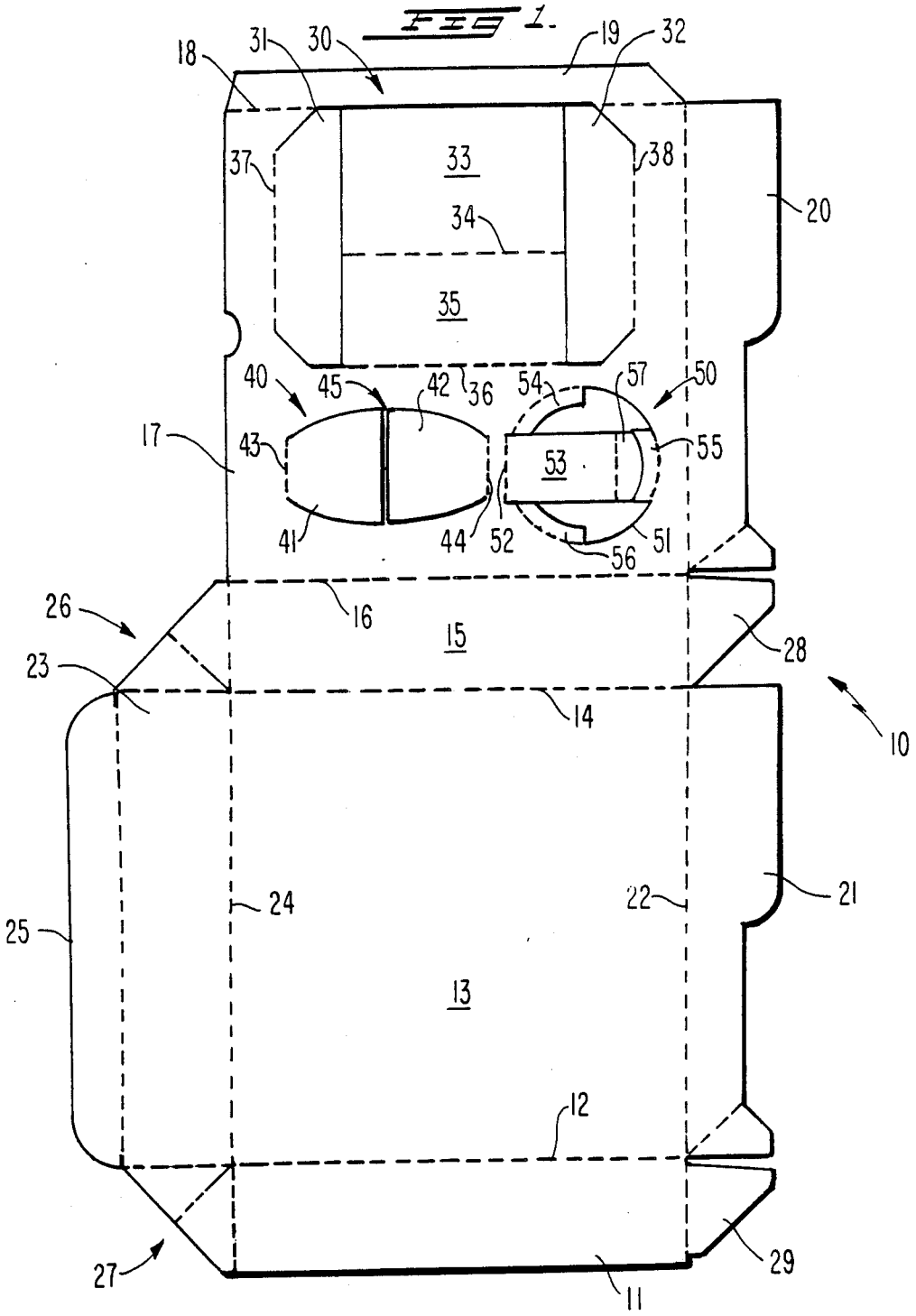
FIG. 1 is a plan view of a paperboard blank useful for making the tray of the present invention.

The carryout tray of the present invention may be formed from a single blank of foldable material 10 as shown in FIG. 1. The blank comprises a first side wall 11 foldably connected to a bottom wall 13 along score line 12. At the opposite side there is another side wall 15 foldably attached to the bottom wall along score line 14. Meanwhile there is a top panel 17 foldably connected to side wall 15 along a score line 16, and a glue flap 19 foldably attached to the opposite side of the top panel 17 along a score line 18. One end of the tray is formed by auto lock end flaps 20,21 and 28,29 foldably connected to one edge of the bottom, top and side walls along a score line 22, and the other end is prepared in the form of a tuck closure comprising flaps 23 and 25 attached to bottom panel 13 along a score line 24 and edge closures 26,27. However, it will be understood that both end closures could be either of the tuck type or the auto lock type if desired.

The top panel is provided with cuts and scores to define three separate food storage areas designated generally by the numerals 30,40,50. The area 30 is generally rectangular in shape and is formed by cut and score lines which define a pair of edge flaps 31,32 which are foldably attached to the top panel 17 along score lines 37,38. The flaps 31,32 are provided only at two opposed edges of area 30 and are of abbreviated length to leave between their outer edges an area of the top panel 17 comprising bridge panel 35 and a bridge flap 33. The bridge panel 35 is foldably attached to the top panel along a score line 36 which is coextensive with the edges of the two flaps 31,32 at one side of opening 30. Meanwhile the bridge panel 35 is attached to the bridge flap 33 along a fold line 34 and the bridge flap 33 has an end which is coextensive with the opposed outer edges of the two flaps 31,32 at the opposite side of opening 30. The distance between the score lines 34 and 36 is designed to be equal to the height of the formed tray.

Area 40 may be of any desired shape, but it is preferably generally of elliptical shape. The opening 40 is defined by cut and score lines which yield a pair of opposed edge flaps 41,42 foldably attached to the top panel 17 along score lines 43,44 and separated form one another by a cut line 45. Meanwhile area 50 is generally circular in shape being formed by a cut/score line 51. The scored sections of line 51 are substantially equally spaced around the area 50 and provide integral tabs 54,55,56 which extend slightly inside the open area 50. Opposite tab 55, the area 50 is partially covered by another flap element 53 which is formed form the top panel material 17 and is foldably attached to top panel 17 doing a score line 52 located more-or-less along the line 51. Flap element 53 includes an end portion 57 separated therefrom along a score line.

The edge flaps 31,32 of opening 30, edge flaps 41,42 of opening 40, and integral tabs 54,55,56 of opening 50 all serve the purpose of frictionally holding the food products in place within their areas of the tray. The edge flaps are deflectable inside the tray when the products are placed in the product receiving openings.

Meanwhile the bridge panel 35 and bridge panel flap 33 serve the purpose of providing support for the top panel 17 and to keep the set up tray from collapsing when loaded.

Figure 2:
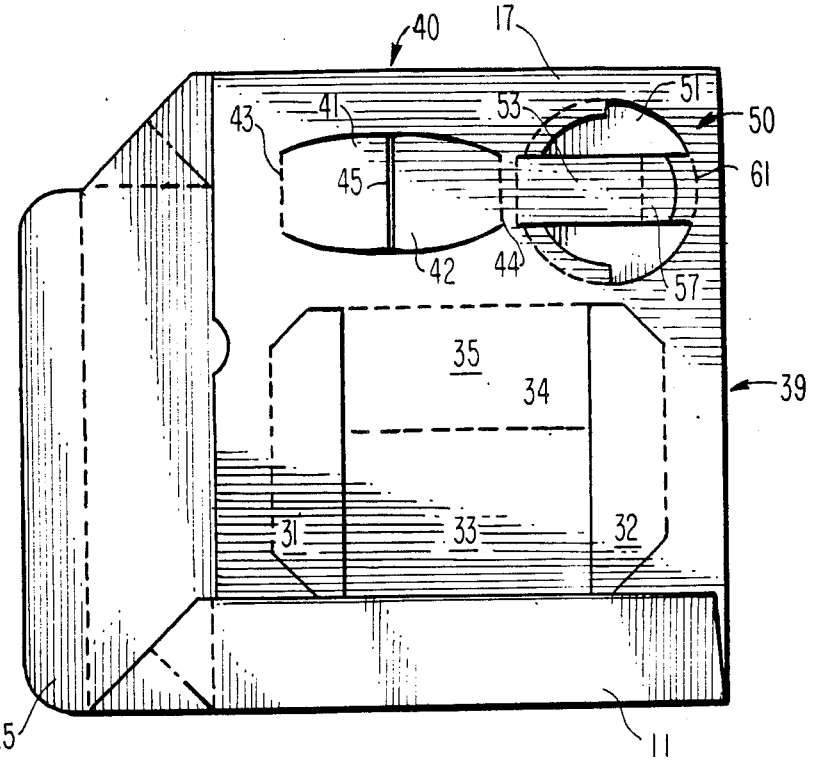
FIG. 2 is a plan view of the folded and glued tray in its collapsed condition.

The blank 10 of FIG. 1 is set up and glued as shown in FIG. 2. The blank is folded twice along score line 16 and score line 12 in order to adhere glue flap 19 to side wall 11. At the same time the autolock bottom is formed by gluing flaps 28 and 29 to flaps 20 and 21 at each corner. Simultaneously, the bridge flap 33 is adhered to the inner surface of bottom panel 13.

Figure 3:
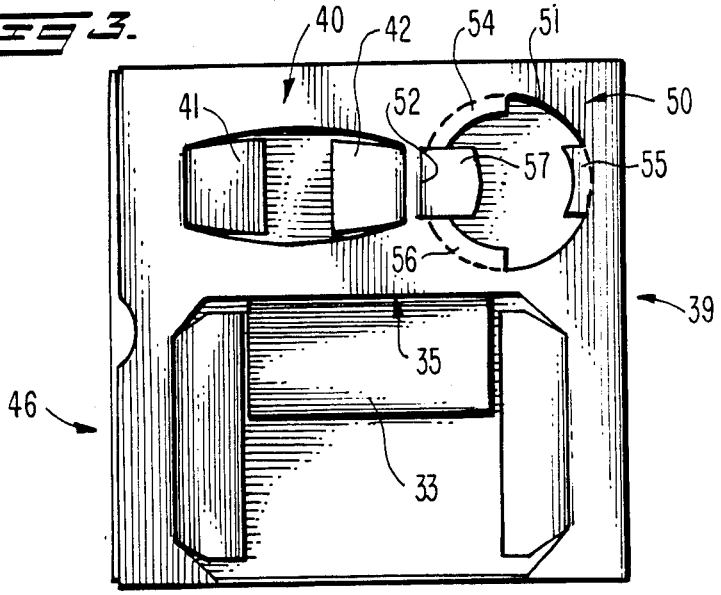
FIG. 3 is a top plan view of the tray of the present invention set up in its erected condition for use; and, FIG. 4 is a perspective view of the carryout tray of the present invention with three different food products in place.

The fully glued tray is stored in the collapsed condition shown in FIG. 2 and is set up for use as shown in FIG. 3.

As the tray is squared for use, by shifting the top panel to the side to raise the top panel 17 into a plane parallel to and above the plane of bottom panel 13, the bridge flap 33 remains attached to bottom panel 13 and the bridge panel 35 shifts from a position generally in the plane of top panel 17 to a position substantially perpendicular to the plane of top panel 17. At the same time, the autolock end flaps 20,21 become engaged in the normal fashion and the tray is fixed in its upright condition by closing the tuck closure 46 at the opposite end of the tray.

Figure 4:
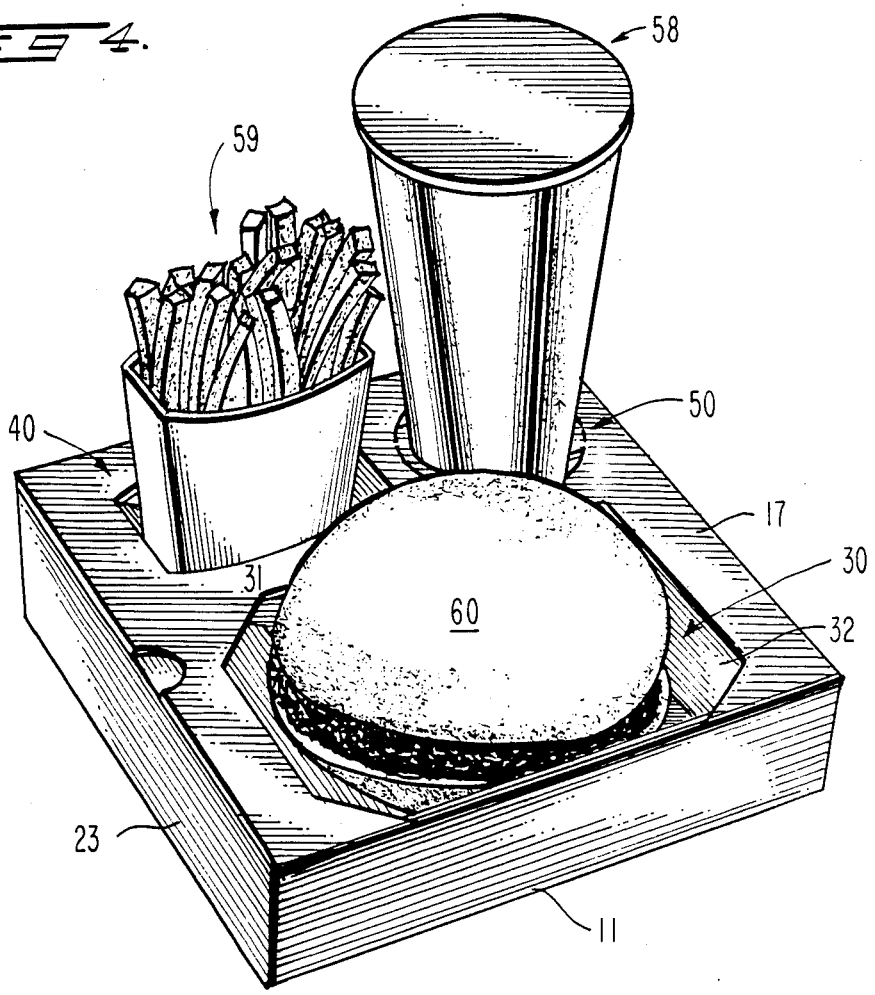

In its fully erect condition as shown in FIG. 4, the tray is ready to accept various food products for carryout. In FIG. 4, area 30 is large enough to hold an entre such as a hamburger or cheeseburger 60, while area 40 accomodates french fries 59, and area 50 accepts a soft drink. It will be appreciated at this point that flaps 31,32 in area 30 effectively hold the burger in place, while flaps 41 and 42 in area 40, and tabs 54,55,56 in area 50 accomplish the same end result.

From the foregoing it will be appreciated that the tray of the present invention provides a convenient and effective means for use by restaurants of all kinds that sell prepared food to be consumed off the premises. Thus, having described the invention in detail, those skilled in the art will appreciate that numerous modifications may be made in the invention without departing from the scope thereof as defined in the appended claims.

What is claimed is:

1. A carryout tray for three different shaped food products, prepared from a single blank of material and capable of being folded from a collapsed condition prior to use into an erect, useable condition comprising.

(a) a bottom wall of generally rectangular configuration having side edges;

(b) a pair of side walls foldably connected to two opposite edges of said bottom wall;

(c) an auto-lock end closure foldably connected to one of the other opposed edges of said bottom wall and a tuck style end closure foldably connected to the remaining opposed edge of said bottom wall;

(d) a top wall foldably connected to one side wall and adhered to the other side wall, said top wall including three different shaped product receiving openings consisting of a first opening of generally rectangular shape, a second opening of generally elliptical shape and a third opening of generally circular shape , said openings being formed by panels deflectable below the top wall comprising foldably connected portions of the material of said top wall, said panels at the first opening comprising full width flaps of abbreviated length with free ends foldably attached to opposite sides of said first opening, said panels at the second opening comprising a pair of opposed edge flaps of generally equal size and shape foldably attached to opposite sides of said second opening, and said panels at the third opening comprising three integral tab elements which extend slightly inside the third open area foldably attached to and equally spaced around the third opening; and, (e) a bridge element formed from the material of said top wall located between the free ends of the full width flaps of said first opening and arranged to separate the top wall from the bottom wall, said bridge element comprising two panels, a first panel foldably connected to the top wall along an edge of said first product receiving opening and a second panel foldably attached to the first panel and adhered to the bottom wall, said first bridge panel being pivotable from a collapsed position adjacent to and located in a plane generally parallel with said bottom wall to an erect position generally perpendicular to said top and bottom walls.

* * * * *